US006148895A

United States Patent [19]

Biggers

[11] Patent Number: 6,148,895

[45] Date of Patent: Nov. 21, 2000

[54] HURRICANE PANEL

[75] Inventor: Douglas W. Biggers, Key Biscayne, Fla.

[73] Assignee: Chill Pill, Inc., Key Biscayne, Fla.

[21] Appl. No.: 08/902,116

[22] Filed: Jul. 25, 1997

Related U.S. Application Data

[63] Continuation of application No. 08/650,802, May 20, 1996, abandoned, which is a continuation-in-part of application No. 08/400,441, Mar. 6, 1995, abandoned, said application No. 08/400,441, is a continuation of application No. 08/179,221, Jan. 10, 1994.

[51] Int. Cl.[7] ..... E06B 3/48

[52] U.S. Cl. ..... 160/183; 160/193; 160/207

[58] Field of Search ..... 160/193, 188, 160/201, 206, 207, 183, 84.01, 84.04, 84.05, 84.06

[56] References Cited

U.S. PATENT DOCUMENTS

| | | | |
|---|---|---|---|
| 1,912,830 | 6/1933 | Crume . | |
| 2,641,018 | 6/1953 | Snyder . | |
| 3,516,470 | 6/1970 | Kurz | 160/35 |
| 3,924,671 | 12/1975 | Gates | 160/183 |
| 4,128,120 | 12/1978 | Frey | 160/191 |
| 4,433,714 | 2/1984 | Barber . | |
| 4,634,172 | 1/1987 | Duda | 296/163 |
| 4,644,724 | 2/1987 | Schijf | 52/588 |
| 4,723,588 | 2/1988 | Ruppel | 160/236 |
| 4,972,894 | 11/1990 | Machill | 160/235 |
| 5,469,905 | 11/1995 | McKinney et al. | 160/183 X |

FOREIGN PATENT DOCUMENTS

| | | | |
|---|---|---|---|
| 332093 | 7/1930 | United Kingdom | 160/207 |

*Primary Examiner*—Blair M. Johnson
*Attorney, Agent, or Firm*—Jack E. Dominik

[57] ABSTRACT

A storm panel for covering a building opening includes, in combination: a series of one-piece, substantially horizontal, substantially identical plate members each having two lateral edges and a main body portion, a first hinge member formed on one lateral edge of each plate member, and, a second hinge member on the opposite lateral edge of each plate member, the first and second hinge members being formed to matingly and pivotally engage the opposite hinge member on an adjacent plate member to form a hinge, the main body portion of each plate member is being joined to each of the lateral hinge edges, the main body portion of each plate member being essentially uninterrupted from the first hinge edge to the second hinge edge and substantially identical with adjacent plate members, the plate members being formed and proportioned along with the hinge members so that when the hinges are hinged to each other to form a panel, the panel is pleatable and the spacing between the plate members when the panel is pleated is dictated by the contact between adjacent hinge members, whereby the amount of space occupied by several of these plate members when pleated in the shutter closed configuration is minimized.

6 Claims, 6 Drawing Sheets

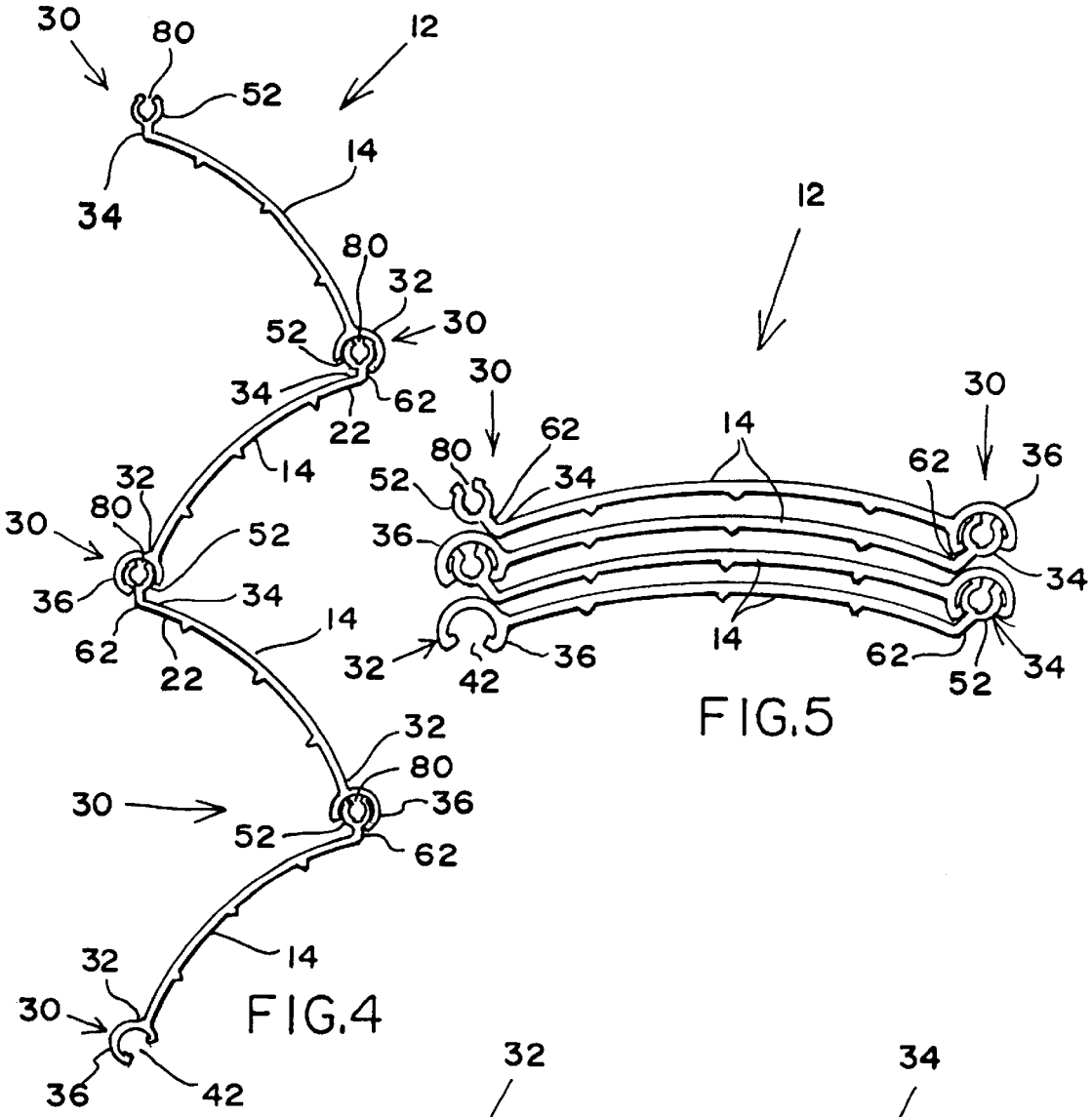
FIG.5
FIG.4
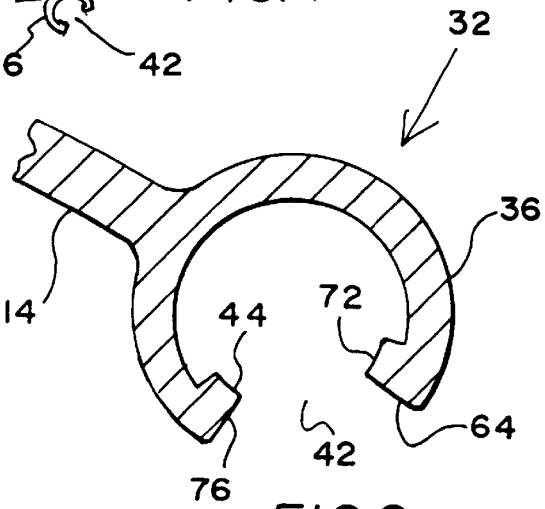
FIG.6
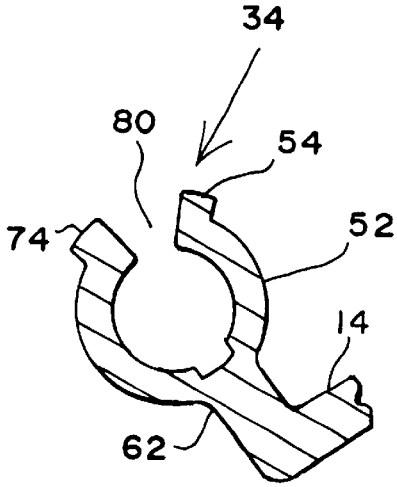
FIG.7

HURRICANE PANEL

CROSS-REFERENCE TO RELATED APPLICATIONS

The present Application is a continuation of application Ser. No. 08/650,802, filed May 20, 1996, by the same inventor herein, entitled "Hurricane Panel", now abandoned which in turn is a continuation-in-part of application Ser. No. 08/400,441, filed Mar. 6, 1995, now abandoned by the same inventor herein. Said application Ser. No. 08/400,441 is a continuation of application Ser. No. 08/179,221, filed Jan. 10, 1994.

BACKGROUND OF THE INVENTION

1. Field of the Invention

The present invention relates generally to the field of storm doors and panels for protectively covering building openings. More specifically, the present invention relates to a composite panel apparatus which includes a series of curved elongate plates hingedly interlocked along their longitudinal edges. This composite panel is deployed along lateral guide members over a building opening, such as a door or a window, by partially unfolding the plates vertically in accordion fashion. Each plate remains angled with respect to the next plate to produce a series of peaks and valleys resulting in an inventively corrugated composite panel. The corrugations substantially enhance the panel strength against the impact of airborne objects in storm winds. The panel is further strengthened by the cross-sectional curvature of the plates and by the inventive double stop hinge structures formed at the longitudinal plate edges. This specially configured, curved and preferably uninterrupted plate cross-section permits the plates to collapse substantially face to face when the panel is folded for storage, the closeness and compactness of the plates being limited only by contact between adjacent plate hinge structures.

2. Description of the Prior Art

There have long been shutters and panels for covering openings in buildings and vehicles. Some of these structures have been intended for protection against storm winds and flying debris, and yet lack sufficient strength to do the job reliably. In addition, they are either impractical or unappealing because they are bulky, obstructive and conspicuous, or have too many separate parts to be economical to manufacture.

Duda, U.S. Pat. No. 4,634,172, issued on Jan. 6, 1987, discloses a rain sealing mechanism for securing a panel to a recreational vehicle. The panel shown in the Duda patent is intended to be merely incidental to a flexible connector which secures the panel. Yet for purposes of the present application, the Duda panel is of greater interest. Duda illustrates a deployable panel formed of a series of elongate plates having pivotally interlocking opposing edges including a C-shaped rail along one edge and a bead along the opposing edge. The rail and bead are sized so that the bead of one plate is retained within the rail of an adjacent plate. The composite panel is stored by gathering the interlocking plates into a roll on a spool. The width of the opening in the C-shaped rail is such that the adjacent panel abuts one edge of the opening when the panel is fully opened and abuts the other opening edge when the panel is fully closed. A problem with Duda if used for storm protection is that the deployed panel presents a substantially planar composite sheet, which is relatively susceptible to bending and crushing failure from object impact. Another problem is that the locking strength of the plate edge structure is limited to the abutment of a plate face against a single opening edge in an adjacent plate. Still another problem is that the plates forming the panels cannot be collapsed face-to-face for compact storage.

Frey, U.S. Pat. No. 4,128,120, issued on Dec. 5, 1978, and Schijf, U.S. Pat. No. 4,644,724, issued on Feb. 24, 1987, both reveal panels made up of plates very similar to those of Duda. Frey and Schijf once again have a C-shaped channel along one plate edge interlocking with a bead along an adjacent plate edge, and open into a substantially planar configuration. As a result, Frey and Schijf present the problems of Duda.

Barber, U.S. Pat. No. 4,433,714, issued on Feb. 28, 1984, teaches a roller shutter door formed of a series of horizontal plates with pivotably inter-engaged edges. One edge is curved back over the plate to form a C-shaped cross-section, and the opposite edge is curved back over the opposite side of the plate in a slightly smaller C-shaped cross-section. The smaller C-shaped edge of one plate fits into the larger C-shaped edge of an adjacent plate. To reduce slackness between the interlocking plate edges, a strip of resilient material is placed inside the smaller C-shaped edge. The plates are bowed to provide a certain degree of corrugation in the deployed panel, but there is a lack of strength at the edge joints which is similar to that described above for Duda. Another problem is that the plates are all convex in the same direction, and thus cannot be collapsed face-to-face into a compact stack.

Kurz, U.S. Pat. No. 3,516,470, issued on Jun. 23, 1970, illustrates a removable storm shutter including a series of hingedly interlocking plates. These plates ride in side channels to collapse substantially in a stack and to deploy into a substantially planar storm panel. Kurz presents the problems identified for Duda. The cross-sectional shape of the plates prevents them from collapsing to an extent that hinges abut. See FIG. 3.

Ruppel, U.S. Pat. No. 4,723,588, issued on Feb. 9, 1988, and Machill, U.S. Pat. No. 4,972,894, issued on Nov. 27, 1990, disclose similar versions of a roller shutter or curtain. The shutters are formed of a series of elongate plates, each having two spaced apart sheet metal face portions closed at their mutual edges. The plates are either left hollow, or are filled with an insulating material. A C-shaped channel is formed at one longitudinal edge, having a flange engagement portion extending part way across its open end. The other longitudinal edge is bent back into a hook-shaped curve to fit into the channel of an adjacent plate and to hingedly interlock with the flange engagement portion along the channel. The problems of Ruppel and Machill are similar to those of Kurz and Duda. Also, as in Barber, the plates are all convex in the same direction, preventing compact face-to-face collapse.

Susnar, U.S. Pat. No. 5,099,904, issued on Mar. 31, 1992, reveals a folding security shutter. The Susnar shutter is formed of an interlocking series of vertical plates riding in top and bottom tracks. During assembly, a bead on each plate longitudinal edge slides into one of two channels in a separate hinge strip. One hinge strip is needed to connect each adjacent pair of plates edges. A problem with Susnar is that the plates and hinge strips are separate pieces, requiring the cost of two extrusions rather than one, and the further cost of assembling the hinge strips and plates.

Panels formed of plates which do not collapse face-to-face include those disclosed in Machill, U.S. Pat. No. 4,972,894, issued on Nov. 27, 1990; Frey, U.S. Pat. No. 4,128,120, issued on Dec. 5, 1978, and Jones, U.S. Pat. No.

4,037,639, issued on Jul. 26, 1977. The plates of Gates, U.S. Pat. No. 3,924,671, issued on Dec. 9, 1975, fold convex face to convex face and thus do not become fully compact. Still other patents covering loosely related subject matter include Auten, U.S. Pat. No. 2,351,656, issued on Jun. 20, 1944; McCabe, U.S. Pat. No. 3,401,734, issued on Sep. 17, 1968; and Snyder, U.S. Pat. No. 2,641,018, issued on Jun. 9, 1953.

It is thus an object of the present invention to provide a folding storm panel apparatus which forms a composite panel with pronounced corrugations when deployed, for reliable strength against wind-driven projectiles.

It is another object of the present invention to provide such a panel apparatus which has double-locking characteristics for stronger joints between deployed plates, again to withstand projectile impact.

It is another object of the present invention to provide such a panel apparatus formed of plates which are cross-sectionally bowed for strength across a wide span and yet are configured cross-sectionally to be capable of collapsing face-to-face and thus occupy minimal space.

It is still another object of the present invention to provide such a panel apparatus in which each plate and its plate hinge structures may be extruded together as one piece for simplicity and minimized cost.

It is finally an object of the present invention to provide such a panel apparatus which is relatively inexpensive to manufacture, install and maintain.

SUMMARY OF THE INVENTION

The present invention accomplishes the above-stated objectives, as well as others, as may be determined by a fair reading and interpretation of the entire specification.

A storm panel is provided for covering a building opening including, in combination: a series of one-piece, substantially horizontal, substantially identical plate members each having two lateral edges and a main body portion, a first hinge member formed on one lateral edge of each plate member, and, a second hinge member on the opposite lateral edge of each plate member, the first and second hinge members being formed to matingly and pivotally engage the opposite hinge member on an adjacent plate member to form a hinge, the main body portion of each plate member is being joined to each of the lateral hinge edges, the main body portion of each plate member being essentially uninterrupted from the first hinge edge to the second hinge edge and substantially identical with adjacent plate members, the plate members being formed and proportioned along with the hinge members so that when the hinges are hinged to each other to form a panel, the panel is pleatable and the spacing between the plate members when the panel is pleated is dictated by the contact between adjacent hinge members, whereby the amount of space occupied by several of these plate members when pleated in the shutter closed configuration is minimized.

The plate main body portion being preferably alternately concave and convex in lateral cross-section so that each plate member nests into an adjacent plate member. The plate main body portion of each plate member is also preferably uninterrupted and curvilinear from the first hinged edge to the second hinged edge. The storm panel preferably additionally includes a pair of opposed, parallel, wall opening mounted lateral panel receiving members, a structure for receiving an anchored position locator interiorly of each of the hinged members at its hinge for securing the panel to be raised and lowered in the area defined by the lateral panel receiving members. Each plate member is preferably extruded, and each plate member is preferably proportioned for a sliding fit of the first and second hinge members, where the plate members may be slidably secured at the hinge member lateral edges to form in combination a panel, without the use of separate machining or of other parts to secure the plate members into the panel assembly. The hinge members on each edge are preferably respectively male and female and formed for a longitudinal sliding engagement of the adjacent panels.

A storm panel is also provided for covering a building opening including, in combination: a series of unitary horizontal plate members each having two lateral edges and a main body portion and terminating in two ends, a first hinge member on one of the lateral edges of each plate member, a second hinge member on the opposite lateral edge of each plate member, each of the hinge members being formed to matingly and pivotally engage the opposite hinge member on an adjacent plate member, the plate members being formed and proportioned along with the hinge members so that when the hinge members are hinged each to the other to form a panel which is pleatable, the spacing between the plate members when the panel is pleated is controlled by the contact between adjacent hinge members.

The main body portion of each plate member is preferably curvilinear from lateral edge to lateral edge. The curvilinear plate member is preferably defined by an arcuate surface. Each of the subject hinge members is preferably cylindrical in basic construction, one of the hinge members is preferably formed to slide interiorly of the other hinge member, where the storm panel may be assembled by slidably engaging adjacent plate members. The exterior portions of each hinge member are preferably circular, and the plate members are preferably formed and proportioned along with the hinge members so that when the hinge members are hinged to each other in pleatable panel form, the spacing between the plate members when the panel is pleated is controlled by the tangential contact between the adjacent circular hinge members. The panel is preferably a unitary extruded one piece member formed of a single extrusion, where each of every one of the plate members in the subject panel are interchangeable each with the other. Longitudinal ribs on the body portion preferably stretch from one end to the other, where in addition to the strength imparted by the curvilinear body portion, the ribs serve to further strengthen the plate members when in the position covering the building opening.

A storm panel is further provided for covering a building opening including, in combination: a series of one-piece, substantially horizontal, substantially identical plate members each having two lateral edges and a main body portion, a first hinge member formed on one lateral edge of each plate member, and, a second hinge member on the opposite lateral edge of each plate member, the first and second hinge members being formed to matingly and pivotally engage the opposite hinge member on an adjacent such plate member to form a hinge, the main body portion of each plate member being joined to each of the lateral hinge edges, the main body portion of each plate member being essentially uninterrupted from the first hinge edge to the second hinge edge and substantially identical with adjactent plate members, the main body portion being alternately concae and convex in lateral cross-section so that each plate member nests into an adjacent plate member, where the amount of space occupied by several of such plate members when pleated in the shutter closed configuration is minimized.

The invention also contemplates a single extrusion being utilized to form the pleated panels of the completed shutter.

The method of the invention is directed to the positioning of the subject panels into a window system. The invention also relates to the orientation of the openings in the knuckles and sleeves of the hinge formed by the lateral edges of the panels in such a fashion that tangential face-to-face contact is made between adjacent panels, and that the opening to the larger knuckle of the extruded lateral edge be positioned downwardly to accommodate drainage.

BRIEF DESCRIPTION OF THE DRAWINGS

Various other objects, advantages, and features of the invention will become apparent to those skilled in the art from the following discussion taken in conjunction with the following drawings, in which:

FIG. 4 is a close-up side view of four plates of the inventive panel in the deployed position showing the edge hinge structures in greater detail.

FIG. 5 is a close-up side view as in FIG. 4, with the panel plates in the folded position.

FIG. 6 is a close-up side view of a first tubular portion of a plate edge, illustrating the first and second inwardly projecting stop flanges.

FIG. 7 is a close-up side view of a second tubular portion of a plate edge, illustrating the first and second outwardly projecting stop flanges.

DETAILED DESCRIPTION OF THE PREFERRED EMBODIMENTS

Figure 1:
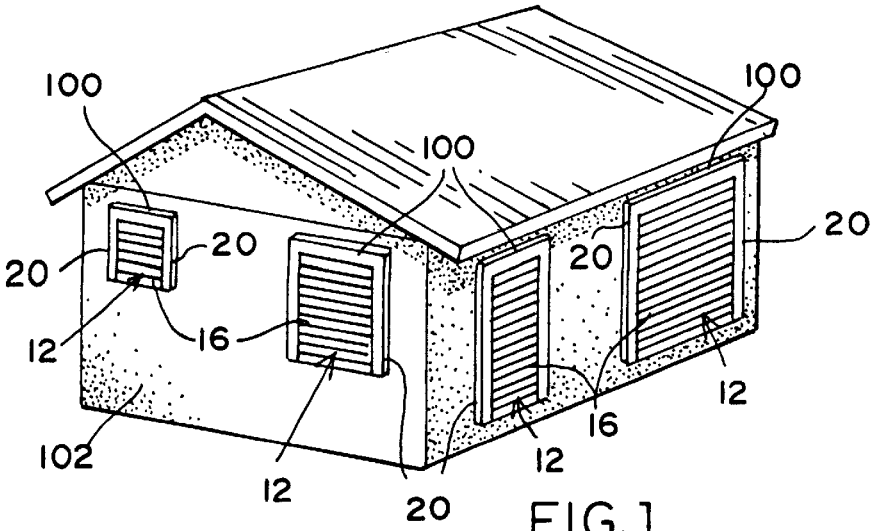
FIG. 1 is a perspective view of a building having two doors and two windows, each of these building openings being covered with the deployed panel apparatus.
Figure 2:
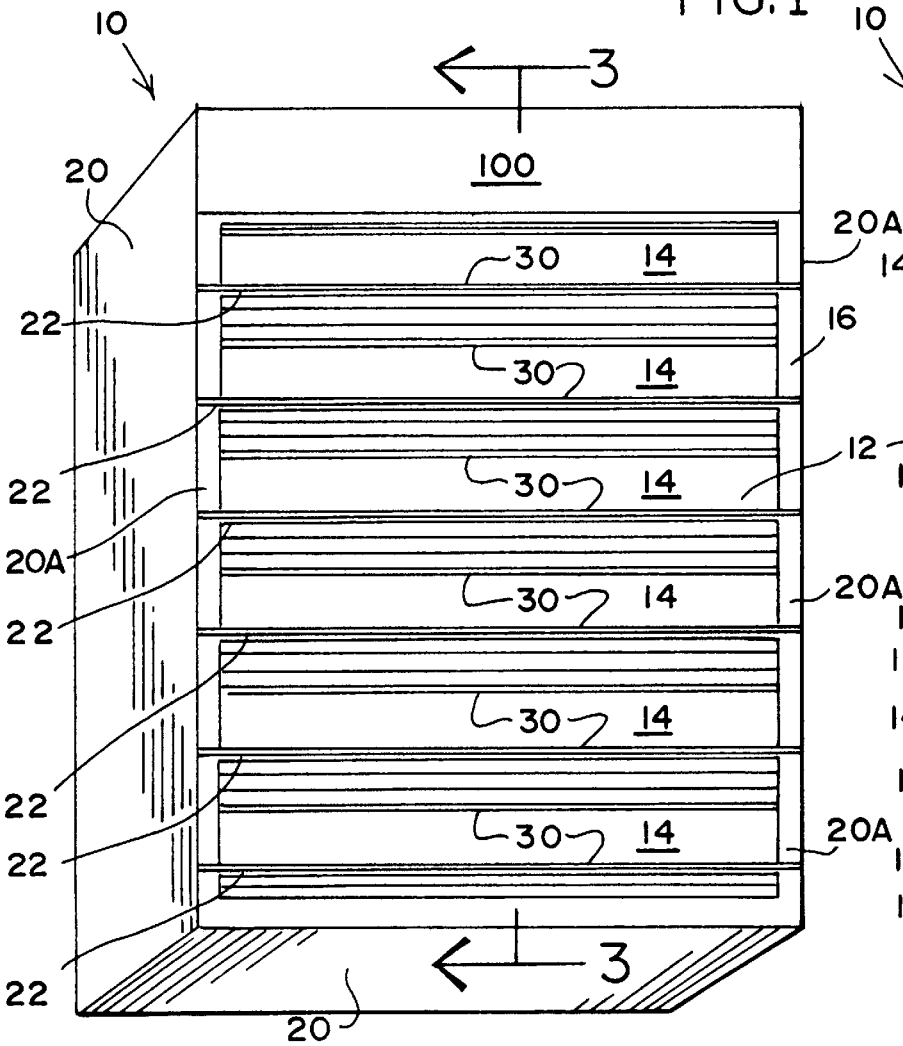
FIG. 2 is a front view of a building window covered by the deployed panel apparatus.
Figure 3:
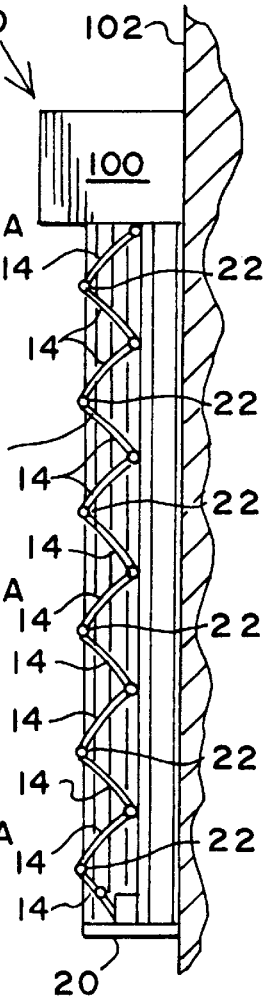
FIG. 3 is a cross-sectional side view of the window and panel of FIG. 2, illustrating the accordion configuration of the deployed panel, forming corrugations for added strength.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–9, a hurricane panel apparatus 10 is disclosed. Apparatus 10 includes a panel 12 formed of a series of elongate plates 14 pivotally interlocked along their longitudinal edges which are deployed over a building opening 16 such as a door or window. See FIGS. 1 and 2. Panel 12 deploys by partially unfolding vertically in accordion fashion along lateral guide members 20, so that each of these plates 14 remains angled with respect the next plate 14 to produce a series of peaks and valleys. This configuration results in an inventively corrugated composite panel 12. See FIG. 3. The corrugations 22 substantially enhance panel 12 strength against the impact of airborne objects in storm winds. Further strength is added by the curvature of plates 14, which permits each plate 14 to support its own weight and also strengthens plates 14 against wind loading and flying debris. The plates 14 in the panel 12 series are alternately concave and convex in cross-sectional curvature to compactly nest together when folded. The cross-section of the first embodiment is preferably uninterrupted for assured compactness. A longitudinal segment of each plate 14, adjacent to a plate 14 longitudinal edge, angles laterally outward from the plate 14 main body portion to permit face-to-face folding of cross-sectionally curved plates 14. As a result, the face-to-face spacing of folded plates 14 is determined only by hinge structure 30 to hinge structure 30 contact.

Panel 12 is further strengthened by inventive, double stop hinge structure 30 formed at the first and second longitudinal plate edges 32 and 34, respectively. See FIG. 4. Hinge structures 30 permit plates 14 to collapse and fold substantially face to face when panel 12 is folded for storage. See FIG. 5. Hinge structures 30 preferably include along a plate first edge 32 a first tubular portion 36 with an open longitudinal first slot 42 forming a C-shaped first edge 32 cross-section. First slot 42 has a first inwardly projecting stop flange 44. See FIG. 6. Along an opposing plate second edge 34 a second tubular portion 52 has a first outwardly projecting stop flange 54. See FIG. 7. First slot 42 and stop flanges 44 and 54 are positioned so that when adjacent plates 14 reach their open, deployed position, the portion 62 of one plate 14 adjacent its second tubular portion 52 abuts a first edge 64 of first slot 42. First outwardly projecting stop flange 54 of second tubular portion 52 simultaneously abuts first inwardly projecting stop flange 44 of first tubular portion 36. As a result, adjacent plates 14 effectively have two stops to doubly secure them when deployed.

In the same way, plates 14 have two stops in the form of second inwardly and outwardly projecting stop flanges 72 and 74. Slot 42 has a second longitudinal edge 76, and first tubular portion 36 has second inwardly projecting stop flange 72. See FIG. 6. Along opposing plate second edge 34 a second tubular portion 52 has a second outwardly projecting stop flange 74. See FIG. 7. Second longitudinal edge 76 of first slot 42, and flange portions 72 and 74, are positioned so that when adjacent plates 14 reach their folded, storage position, the portion 62 of the one panel 12 adjacent its second tubular portion 52 abuts a second edge 76 of first slot 42. Second outwardly projecting stop flange 74 of second tubular portion 52 simultaneously abuts second inwardly projecting stop flange 72 of first tubular portion 36. These double stop structures make composite panel 12 inventively sturdy and secure in both deployed and storage positions.

Plates 14 are preferably formed bowed around their longitudinal axes for added strength against bending and for more efficient folding. A second slot 80 is preferably provided in second tubular portion 52 so that the first and second outwardly projecting stop flanges 54 and 74 can be bent out from the longitudinal edges of second slot 80.

Guide members 20 each preferably include an extruded aluminum structure having a guide channel 86. See FIGS. 8 and 9. A guide carriage member 90 is mounted to plates 14 with a fastener guide assembly 98 screwed into the hinge structure inner tubular portion 36 at the interiorly directed panel 12 peaks. A guide roller 112 encircles assembly 98 to ride against a guide channel flange portion 116. Cross axles 118 extend from guide assemblies 90 to mount guide wheels 120, which ride within channel tracks 122 so that panel 12 rides smoothly and solidly within guide channels 86.

Figure 10:
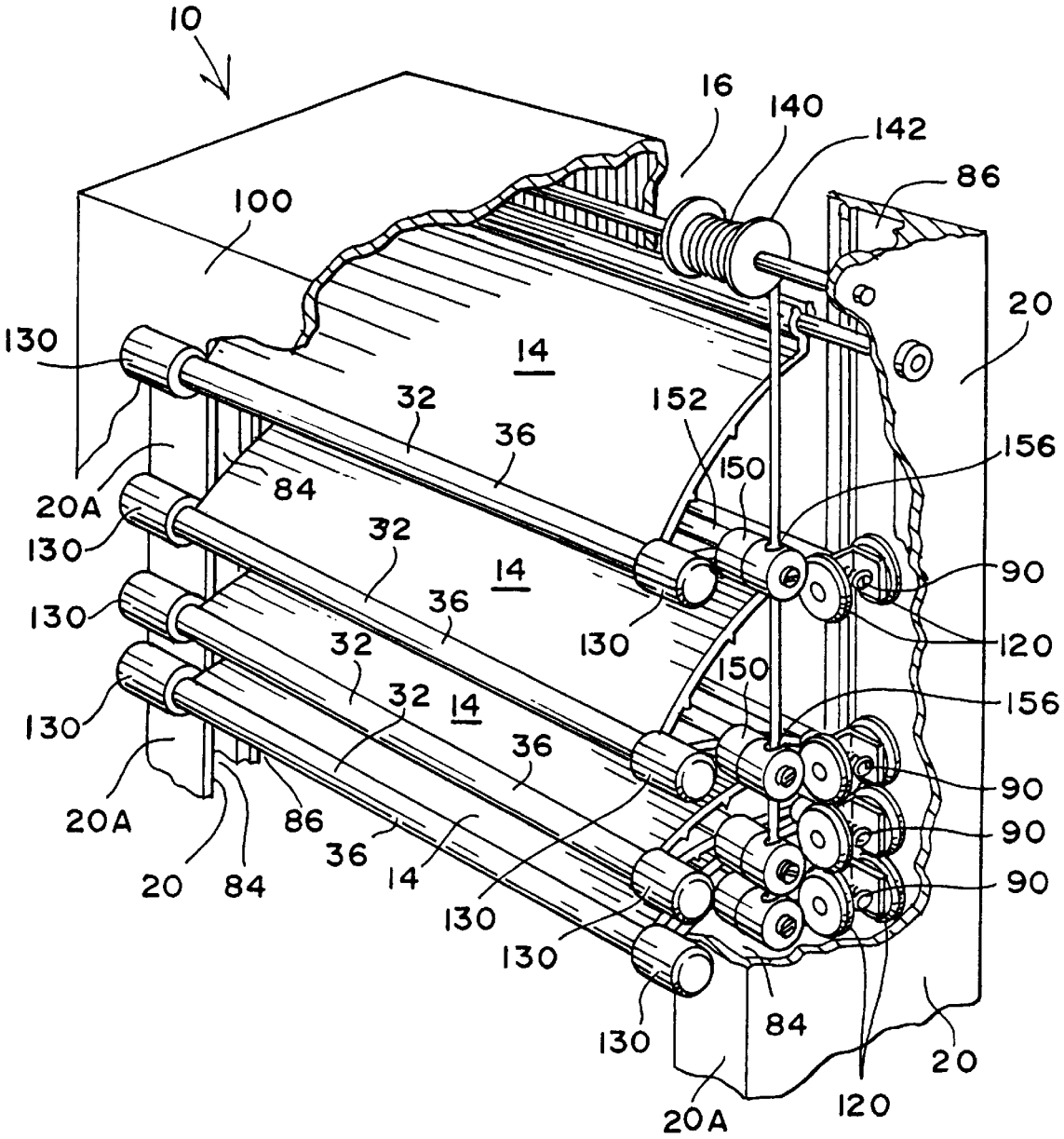
FIG. 10 is a perspective view of a building opening fitted with the second embodiment of the inventive panel apparatus, shown in a partially deployed position. One of the channel members is broken away to reveal the rope, spool and rope engaging assemblies at an end of every other plate in the panel.

A fastener opening stop assembly 130 is screwed into the hinge structure inner tubular portion 36 at the exteriorly directed panel 12 peaks. Opening stop assemblies 130 abut the outer faces 20*a* of guide members 20 when panel 12 is deployed to a desired maximum extent, where plates 14 form the desired corrugated, peaked configuration. These assemblies 130 are also visible in FIG. 10, against the guide member 20 outer faces 20*a*.

Figure 8:
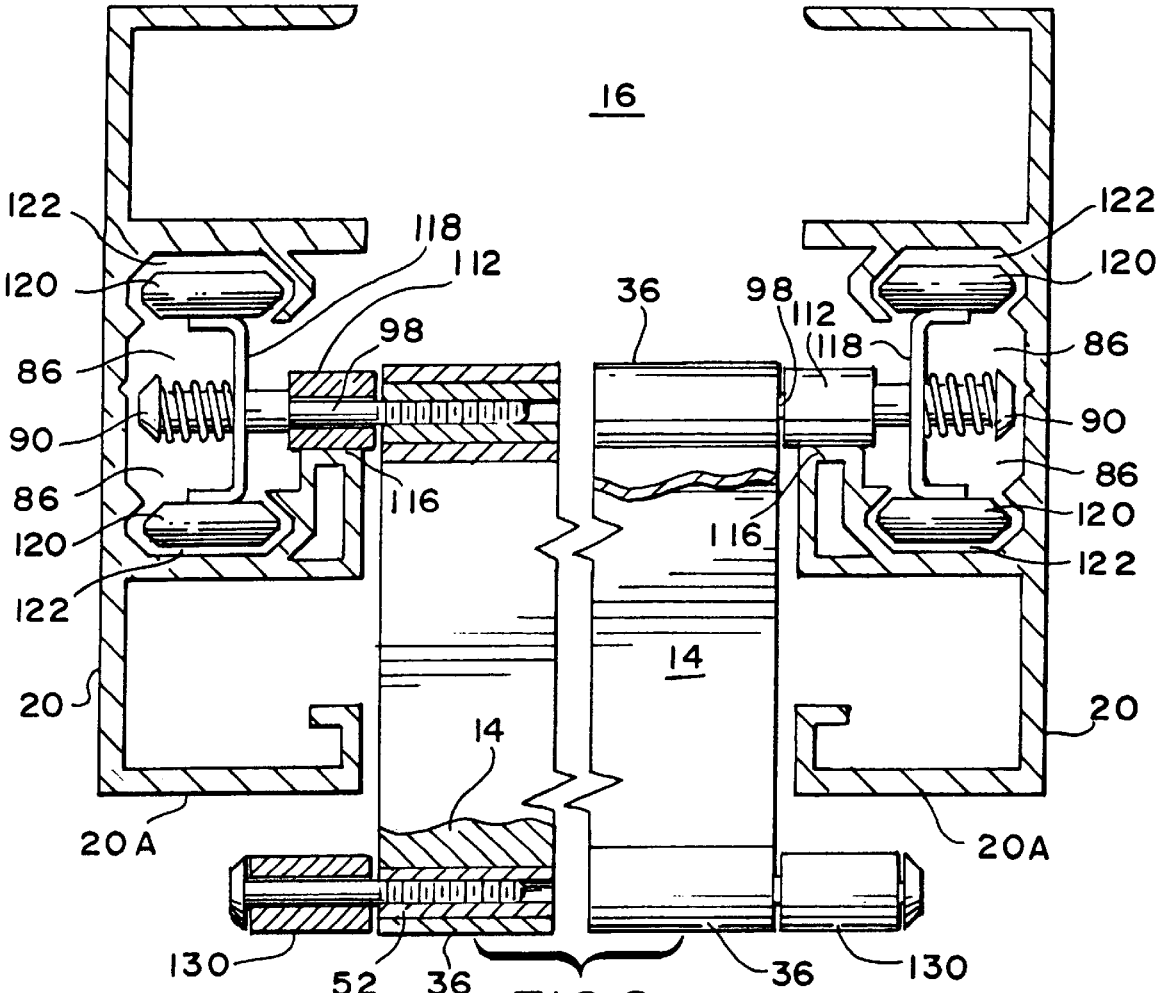
FIG. 8 is a cross-sectional top view of the inventive guide members and the ends of a plate riding in the guide members.
Figure 9:
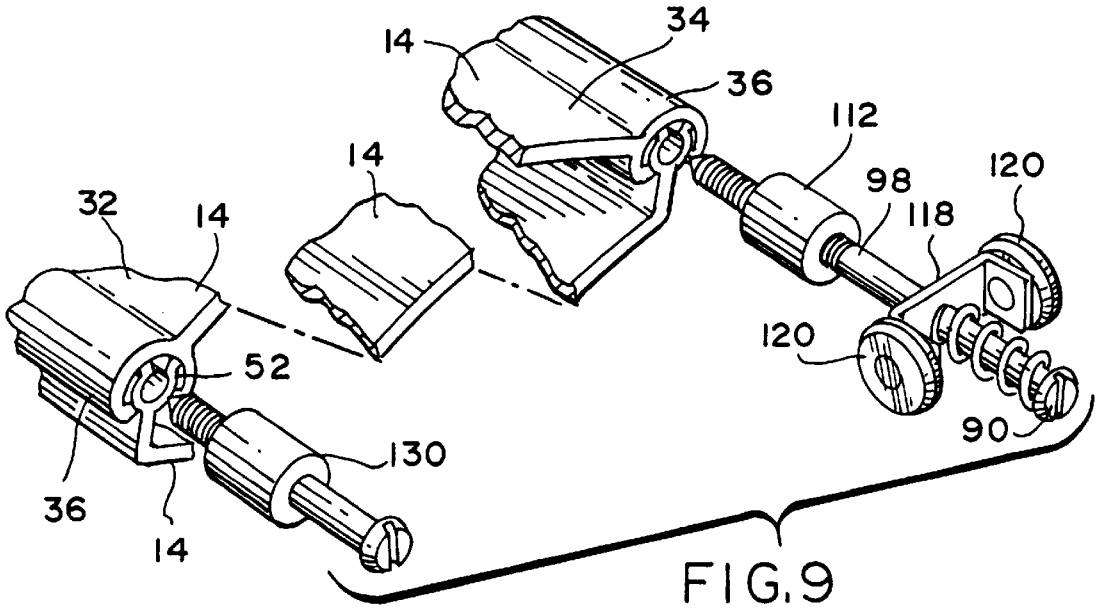
FIG. 9 is a fragmented perspective view of an end of a panel plate, showing in exploded relation to their plate mounting positions the guide and opening stop assemblies of the first embodiment. Portions of panel plates interconnected with the fragmented plate are also shown.

Panel 12 folds upwardly into a storage housing 100 to expose a building opening 16. Storage housing 100 is preferably an elongate box fastened to the building wall 102 above opening 16. As panel 12 is folded, assemblies 130 ride outwardly from the guide member 20 outer faces 20*a*, as shown in FIG. 8.

It will be noted particularly in FIGS. 4–7 that the plates 14 for each and every portion of the shutter panel 12 is identical to each other. The slots 42 in the larger of the two adjacent panels 32 is formed to receive the curved end portion of the opposite lateral edge 34. When the shutters are assembled, they are assembled alternatively and when strung vertically each panel is either convex inwardly or outwardly. In this fashion additional strength is imparted to the completed shutter system when extended to shield an adjacent window.

Second Preferred Embodiment

Figure 11:
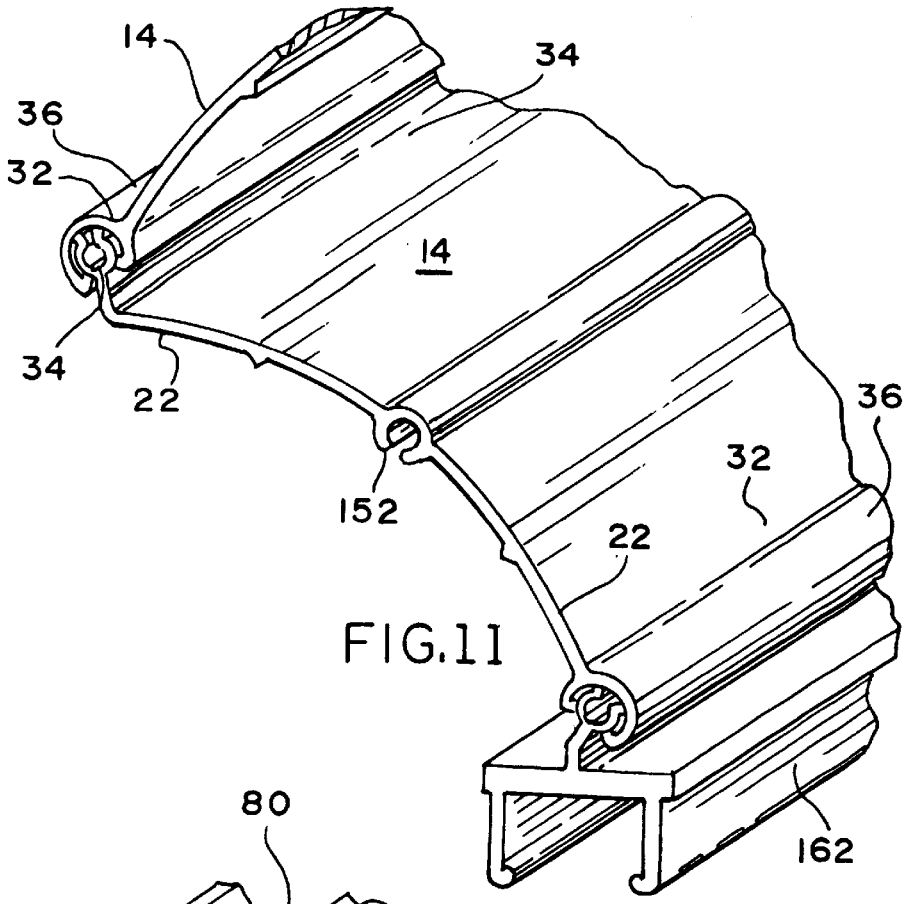
FIG. 11 is a broken away perspective view of two interconnected plates in a deployed, corrugated position, the lower plate being pivotally connected to a window sill anchoring member with a center tubular plate channel which becomes the lifting point on the bottom elongate plate.
Figure 12:
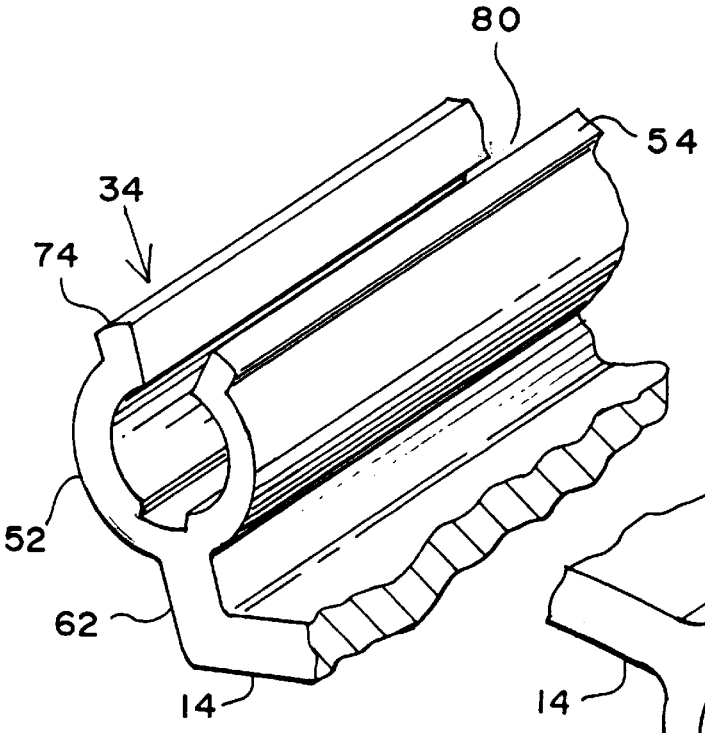
FIGS. 12 and 13 are broken away, perspective close-up views of the hinge structure first and second tubular portions of a given plate, common to both preferred embodiments.
Figure 13:
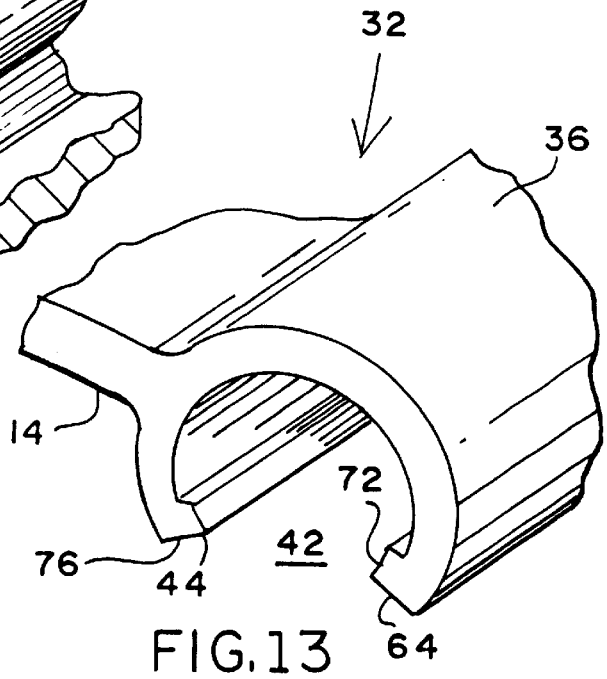
Figure 15:
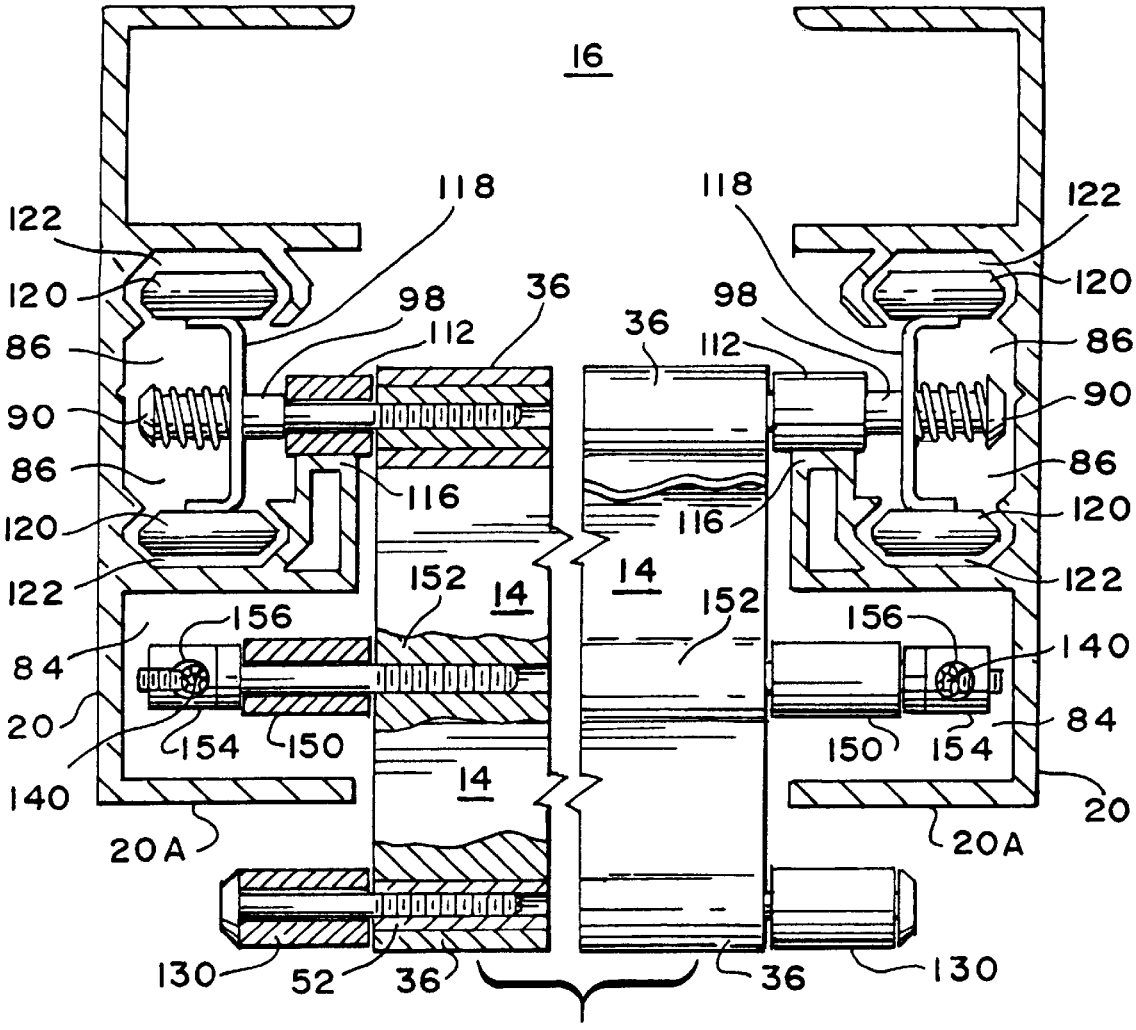
FIG. 15 is a cross-sectional top view of the apparatus as in FIG. 8, with the rope engaging assemblies added as described in the description of the second preferred embodiment.
Figure 14:
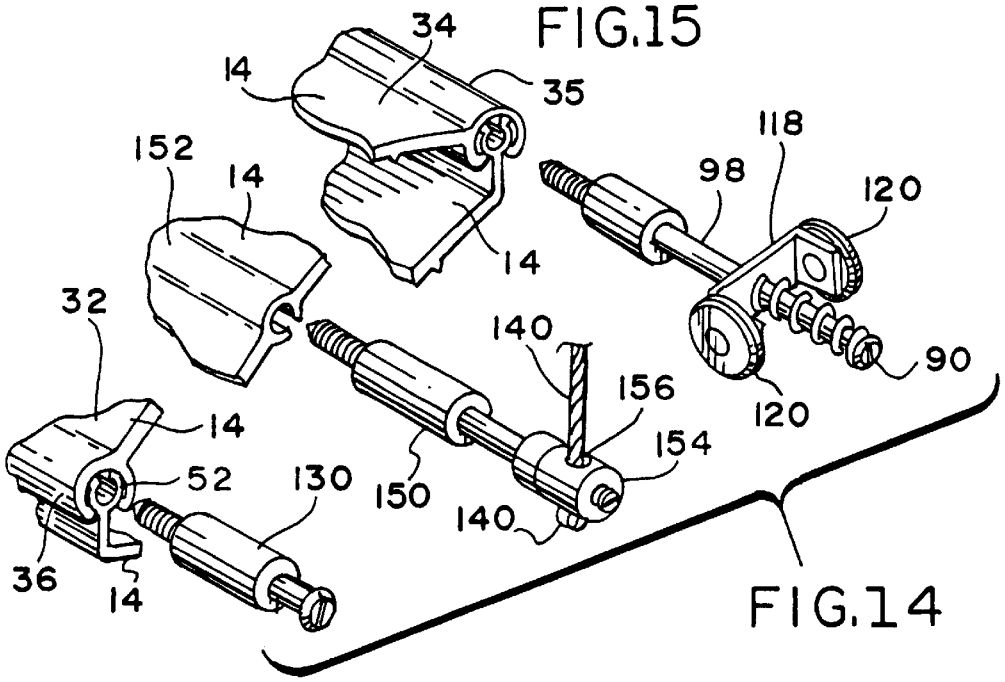
FIG. 14 is a fragmented perspective view of an end of a panel plate as in FIG. 9, showing in exploded relation to their plate mounting positions the fastener guide and fastener opening stop assemblies of the first and second embodiments, and the rope engaging assembly of the second embodiment only. Portions of panel plates interconnected with the fragmented plate are also shown.

The second preferred embodiment is like the first except that a panel 12 collapsing and deploying rope 140 is provided, which is preferably a rope cable of interwoven wire. Rope 140 is wound around and unwound from a gathering spool 142. See FIGS. 10–15. This winding and unwinding is accomplished by rotating spool 142 with winding means such as a motor or hand crank (not shown). Rope 140 extends to and passes through a fastener rope engaging assembly 150 secured to an end of every other plate 14, or perhaps every fifth plate 14, in panel 12. For this embodiment, a special tubular plate channel 152 is provided in these extruded plates 14 inserted periodically throughout the plate 14 series. See FIGS. 11–13. A rope engaging assembly 150 screws into the opposing ends of tubular plate channel 152. See FIG. 14. Channel 152 is slotted to permit resilient channel 152 gripping of assembly 150. Each assembly 150 has a rotatably mounted cylindrical tip segment 154 including a diametric rope receiving port 156. Rope 140 is fitted through all ports 156 along a given panel 12 lateral end, to keep the rope from bowing out or hanging up, and is tied just below the bottom-most tip segment 154. The knot abuts and supports the bottom-most tip segment 154 to lift the panel 12 during panel 12 retraction. Rope engaging assemblies 150 ride within rope tracks 84 within guide members 20. See FIG. 15. The lowest plate 14 of panel 12 is preferably pivotally connected to a window sill latching member 162, as shown in FIG. 11. The leg portions of window sill latching member 162 snap over an elongate horizontal portion of the sill (not shown).

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A storm panel for covering a building opening comprising, in combination:

a series of one-piece, substantially horizontal, substantially identical elongated plate members each having two lateral edges, a main body portion, and opposed end portions, a first hollow hinge member formed on one lateral edge of each said plate member, and a second hollow hinge member on the opposite lateral edge of each plate member, said first and second hollow hinge members being formed to matingly and pivotally engage the opposite hollow hinge member on an adjacent such plate member to form a hollow core hinge, the main body portion of each of said plate member being joined to each of said lateral hollow hinge edges, said plate members being joined by said hinge members to form said panel the main body portion of each of said plate member being transversely curvilinear and imperforate from said first hollow hinge edge to said second hollow hinge edge and substantially identical with adjacent plate members and said main body portions being alternately concave and convex in lateral cross-section such that each said plate member nests into an adjacent said plate member in a convex concave, adjacent juxtaposition, said plate members being formed and proportioned to be concave downwardly, at least a plurality of said plate members having a rope engaging assembly at a mid portion of its ends, one of said plurality plate members being positioned at the bottom of the plurality of plate members a plurality of said plate members except the bottom most plate member each being slidably engaged by a rope passing through the rope engaging assembly;

the rope engaging assembly of said bottom plate member being fixedly engaged by said rope and oriented to progressively shift the lifting load from the panel center to the tangentially contacted lateral hollow hinge edges;

whereby the amount of space occupied by a plurality of such plate members when pleated in the shutter closed configuration is minimized, and whereby the entire assembly of plate members can be raised by the rope without the necessity for a footer, and whereby convex concave corrugated like nesting members at the raised position resist buckling and bending of the kind which occurs when the plate members are flat.

2. A storm panel according to claim 1, wherein said hollow hinge structure between two adjacent plates comprises:

a downwardly facing first tubular portion along a first plate member edge, having an open longitudinal first slot forming a substantially C-shaped edge cross-section, said first slot comprising a first inwardly projecting stop element, an upwardly facing second tubular portion along a second plate member edge, said plate member having an open longitudinal second slot forming a substantially C-shaped edged cross-section, and having a hollow core edge having a first outwardly projecting stop element, wherein said first slot and said first inwardly and outwardly projecting stop elements are positioned such that when said plate members reach a deployed position, a portion of said second plate member adjacent to said second tubular portion abuts a first edge of said first slot, and said first outwardly projecting stop element of said second tubular portion simultaneously abuts the first inwardly projecting stop element of said first tubular portion.

3. A storm panel according to claim 1, wherein said hollow hinge structure between two adjacent plates comprises:

a downwardly facing first tubular portion along a first plate member edge having an open longitudinal first slot forming a substantially C-shaped edge cross-section, said first slot including an inwardly projecting stop element, an upwardly facing second tubular portion along a second plate member edge having an open longitudinal second slot forming a substantially C-shaped cross-section and having a hollow core having a second outwardly projecting stop element, wherein said first slot and said second inwardly and outwardly projecting stop elements are positioned such that when said plate members reach said folded position, a portion of said second plate member adjacent to said second tubular portion abuts a second edge of said first slot, and said second outwardly projecting stop element of said second tubular portion simultaneously abuts said second inwardly projecting stop element of said first tubular portion.

4. The storm panel of claim 1, above, further comprising a pair of opposed, parallel, wall opening mounted lateral panel receiving members, the panel receiving members; being proportioned to receive both the shutter system and a window, a means for receiving an anchored position locator interiorly of each of the hinged members at its hinge, guide carriage means secured at the ends of the hollow hinges proportioned to move up and down in a track area defined by the lateral panel receiving members.

5. A method for forming a storm panel for covering a building opening formed from a series of one piece, substantially horizontal, substantially identical plate members each having two lateral edges and a main body, said main body being curvilinear between the edges presenting one convex face and one concave face, each edge member being tubular with a longitudinal slot therein, one edge member being larger than the other edge member, said larger edge member having an interior opening sufficiently to slidably receive the tubular smaller edge member, the larger edge member having its longitudinal opening facing downwardly, and the smaller edge member having its opening facing upwardly, comprising the steps of:

extruding the subject plate member and cutting the same to the length intended for the panel opening covering of the enclosure, sequentially securing the like plate members by inserting the one into the other with an orientation such that when extended in the full extended position covering the building opening the plates are alternatively convex and concave facing, and, reversing the plates so that the opening on the larger lateral edges extend downwardly, and the opening on the smaller lateral edges extend upwardly when tubularly and slidingly engaging the adjacent plate, framing the subject secured plate members between laterally opposing channels at alternate lateral hinge positions thereby defining a channel retained hinge and a free end hinge at the opposite edge thereof, forming a rope engaging assembly at opposed ends of a plurality of such plate members, at a mid-portion of the ends, passing a rope through a rope guide member which is positioned at a mid point of the ends a plurality of of the plate member so as to be slidable therein, fixedly securing the rope to the rope guide member of the lowest plate, utilizing the lowest plate member to transmit the lifting effort progressively to each hinged plate member above it; and providing a means for shortening the rope, said means for shortening being at the top of the panel to thereby lift the panel shutter in a retracted upward position, whereby the concave convex relationship of the plate member will inhibit the bending which occurs in flat such plates, and at the same time, saving weight by eliminating the necessity of a footer to raise and pleat the plate members into the retracted position.

6. A storm panel for covering a building opening comprising, in combination, a series of one-piece, substantially horizontal, substantially identical plate members each having two lateral edges and a main body portion, a first hinge member formed on one lateral edge of each said plate member, a second hinge member on the opposite lateral edge of each plate member, said first and second hinge members being formed to matingly and pivotally engage the opposite hinge member on an adjacent such plate member to form a hinge, the main body portion of each plate member being joined to each of said lateral hinge edges, each of the main body portions of said plate members being curved between the lateral edges thus defining convex and concave faces on opposite sides of the plate and uniformly so to permit an adjacent plate member to nest in a convex concave relationship between opposed plate members, each of said plates being oriented with the adjacent plate to present a convex upward plurality of faces when retracted, a rope engaging assembly at the bottom plate member of said panel and a rope engaging assembly on the ends of a plurality of said plate members above bottom plate member, a rope passing through the rope engaging assemblies and to fixedly and permanently engaging the rope engaging assembly of the bottom plate, and also engaging said rose engaging assemblies of said plates for purposes of stabilizing the panel, plurality of plate members whereby drainage and lifting stability is promoted by the upward orientation of the convex surface of each panel as assisted by the rose and the rope engaging elements.

* * * * *